US005131885A

United States Patent [19]

Nakao et al.

[11] Patent Number: 5,131,885

[45] Date of Patent: Jul. 21, 1992

[54] COIN SEPARATING AND COUNTING APPARATUS

[76] Inventors: Tetsuo Nakao, 1-68, Higashi 2-chome, Nakano-cho, Tondabayashi, Osaka, Japan; William Chuang, 2 Fl., No. 35, Lane 244, Tunhwa N. Rd., Taipei, Taiwan, both of Taiwan

[21] Appl. No.: 671,970

[22] Filed: Mar. 19, 1991

[51] Int. Cl.[5] ..... G07D 3/04

[52] U.S. Cl. ..... 4532/11; 453/56

[58] Field of Search ..... 194/334; 453/7, 9, 11, 453/56

[56] References Cited

U.S. PATENT DOCUMENTS

| | | | |
|---|---|---|---|
| 2,101,513 | 12/1937 | Samuelsen et al. | 453/11 |
| 3,135,270 | 6/2964 | Arnold | 453/9 |
| 3,351,075 | 11/1967 | Weisskopf | 453/7 |
| 3,431,920 | 3/1969 | Zimmermann | 453/9 |
| 4,261,377 | 4/1981 | Ueda | 453/11 |
| 4,416,299 | 11/1983 | Bergman | 453/56 |

FOREIGN PATENT DOCUMENTS

| | | | |
|---|---|---|---|
| 0058374 | 1/1941 | Denmark | 453/9 |
| 2243941 | 3/1974 | Fed. Rep. of Germany | 453/11 |
| 0714944 | 11/1931 | France | 453/9 |

*Primary Examiner*—Robert J. Spar
*Assistant Examiner*—William M. Hienz
*Attorney, Agent, or Firm*—Bacon & Thomas

[57] ABSTRACT

An apparatus for separating and counting coins comprising a pair of rail spaced from each other to define a coin slot and a closed-loop chain for stably moving coins of different diameters on the pair of rails. The two rails are inclined with respect to a horizontal plane so that the coins are supported thereon in an inclined manner. The coin slot increases incrementally from an upstream of the coin slot to a downstream of the coin slot. Each coin, which has a diameter larger than a first width of the coin slot at the upstream and smaller than a second width of the coin slot at the downstream and moves along the coin slot, falls from the pair of rails. A counting device is suitably provided near the coin slot so that, upon falling of the coin, a count is registered.

1 Claim, 2 Drawing Sheets

COIN SEPARATING AND COUNTING APPARATUS

BACKGROUND OF THE INVENTION

The present invention relates generally to a coin separating and counting apparatus for separating coins in accordance with a difference in diameter and counting the number of coins in a respective set of separated coins that is introduced into a corresponding segment of a coin passage. More particularly, the present invention relates to an inclined type coin separating and counting apparatus, in which a coin passage defined between an upper inclined rail and a lower inclined rail has a width incrementally increasing from an upstream thereof to a downstream thereof, and a coin moving along the coin slot and having a given diameter falls from the lower inclined rail at a specific segment of the coin slot that is determined by both the coin diameter and the corresponding width of the coin slot at that specific segment. Each coin that has fallen at a specific segment is counted. A conveying means is provided to move the coins of various diameter along the coin slot automatically.

Devices capable of counting a number of coins of a specific diameter are known. Also, coin separators capable of separating coins and introducing the separated coins into coin passages in accordance with the type of coins are known. But a device which can be used to automatically count a respective number of coins of various diameters is still not available. Therefore, it will be convenient to have a coin separating and counting device which can be used to separate the coins of various diameters contained in a certain location according to their diameters and then count a respective number of coins of a specific diameter separated or selected.

SUMMARY OF THE INVENTION

Accordingly, it is an object of this invention to provide a coin separating and counting apparatus comprising a coin slot defined between a pair of inclined rails, the coin slot incrementally increasing from an upstream thereof to a downstream thereof, so that coins of various diameters, which are initially supported on the lower inclined rail, resting against the upper inclined rail, are moved in a direction sequentially from the upstream of the coin slot to the downstream of the coin slot, no longer rest against the upper inclined rail but will fall from the lower inclined rail when the coin is moved to a position where a diameter of the coin is smaller than the width of the coin slot at that position.

A further object of this invention is to provide a coin separating and counting apparatus in accordance with the above which moves the coins along the coin slot in a sliding, instead of a rolling manner.

Another object of this invention is to provide a coin separating and counting apparatus in accordance with the above which retains the coins on the conveying means stably.

Yet a further object of the invention is to provide a coin separating and counting apparatus in accordance with the above which counts a respective number of the coins separated or selected subsequent to the falling of the coin.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENT

Figure 1:
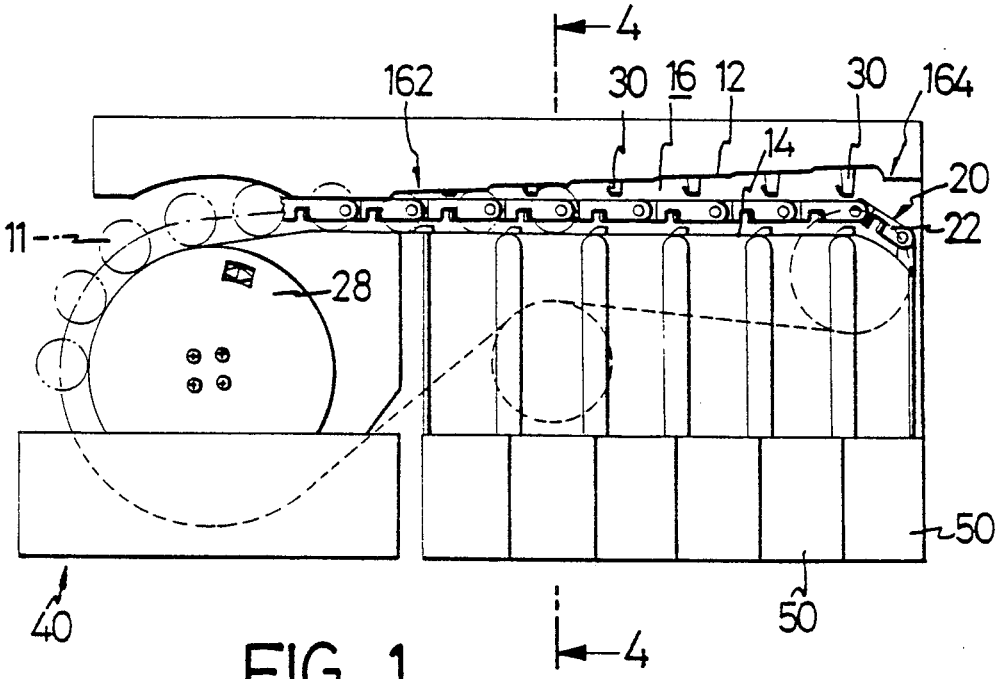
FIG. 1 is an elevational plan view showing a coin separating and counting apparatus in accordance with the present invention.

Referring now to the drawings, and initially to FIG. 1, there is shown the coins separating and counting apparatus. Basically, the apparatus of the invention comprises an upper and a lower rail 12 and 14 defining a coin slot 16 therebetween, a first box 40 containing coins 11 of different diameters to be separated, a conveying means 20 comprising an endless chain 22 for moving coins 11 from the first 40 box along the coin slot 16 in a desired manner, and a plurality of counting means 30 each for counting a number of the coins separated into a respective second box 50 provided near the coin slot 16. The coins of different diameters are each selected from the first box 40 under a rotational action of the conveying means 20 that turns a rotating plate 28 via the chain 22. The selected coins are retained on the chain 22 and are automatically, sequentially transferred to the site near the coin slot 16. Since it is obvious to those skilled in the art to utilize the chain herein disclosed as the conveying means for moving coins in a manner shown by dotted liens in FIG. 1, detailed description for the first box 40 and the rotating plate 28 need not be given here.

Figure 2:
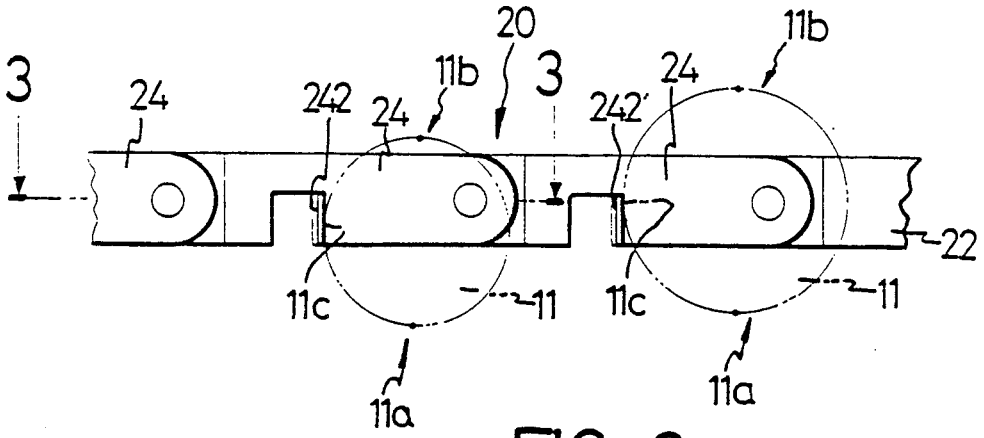
FIG. 2 is an enlarged detailed view of a conveying means of the invention, showing particularly the construction and use thereof in accordance with the present invention.
Figure 3:
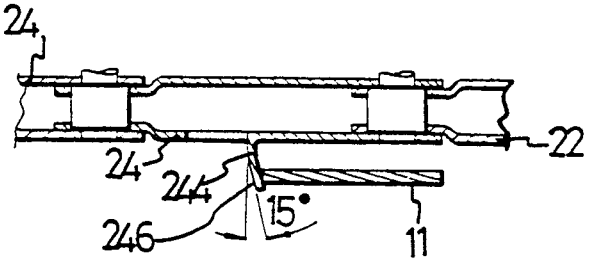
FIG. 3 is a top view along line 3—3 of FIG. 2.

FIGS. 2 and 3 show the chain of the conveying means 20 in greater detail. The chain 22 comprises a protruding or punch-out plate 242 on a respective link plate 24 thereof. The punch-out plates 242 remove the coins from the first box 40 and bring the coins to the site near the coin slot 16, where a bottom point **11*a* of the coin is supported by the lower inclined rail 14, and a top portion 11*b* thereof rests against the upper inclined rail 12. It is noted that the punch-out plate 242 is sized to have a width sufficiently large to contact a leftmost point 11*c* of the coin, as clearly shown in FIG. 2. In other words, each punch-out plate 242** has a longitudinal width configured so as to contact tangentially transverse diameters of the coins.

FIG. 3 shows that each punch-out plate 242 extends substantially perpendicular to one side of the link plate 24 of the chain 22. Preferably, the punch-out plate 242 is composed of a main portion 244 integrally perpendicular to the link plate 24 and a distal outer end 246 angling at about 15 degrees toward the moving direction of the chain 22. This design insures that the coins are stably supported and moved by the punch-out plates 242 during movement of the chain 22.

Referring to FIG. 1 again, it can be seen the coin slot 16 defined between the upper and lower inclined rails 12 and 14 incrementally increases from an upstream thereof, generally designated by reference numeral 162, to a downstream thereof, generally designated by reference numeral 164. At the upstream 162, the width of the coin slot 16 is generally not larger than a diameter of the smallest coin to be processed, i.e., separated and counted. At the downstream 164, the width of the coin slot 16 is generally not less than a diameter of the largest coin. Between the upstream 162 and the downstream 164, the coin slot 16 may be divided into segments according to a number of the type of coins to be processed. It is clear that the above arrangement allows any coin to be separated according to its diameter by the coin slot 16.

Figure 4:
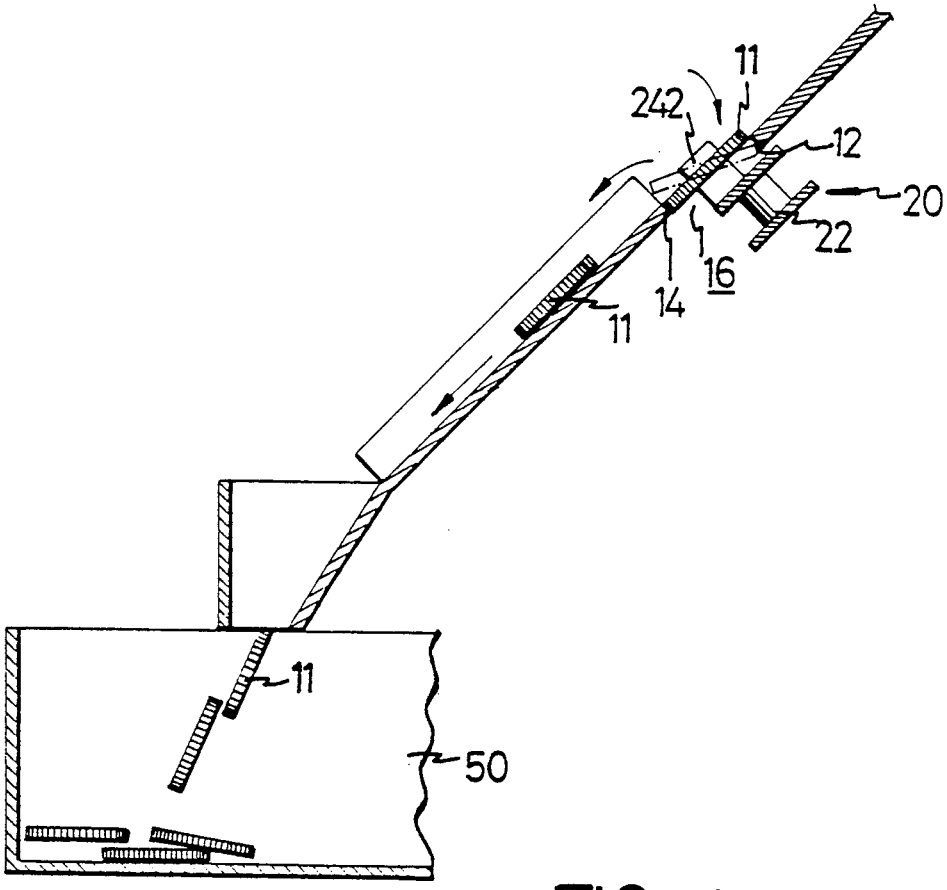
FIG. 4 is a cross-sectional view taken along line 4—4 of FIG. 1.

FIG. 4 illustrates a side cross-sectional view of the apparatus of the invention, which shows how the coins can be introduced into the second box 50. Since the coins 11 are supported by the upper and lower inclined rails 12 and 14 in an inclined manner, the coin 11 will fall from the chain 22 of the conveying means 20 once it is moved to a position where the width of the segment of the coin slot 16 is larger than the width of the coin 11. During the fall of the coin 11, the counting means 30 disposed adjacent to the coin slot 16 will be struck by the coin 11 and will register accordingly. Thus, the provision of the conveying means 20 for moving the coins 11 along the coin slot 16 and the incrementally increasing coin slot 16 for separating the kind of coins 11 effectively achieves the separating and counting of coins according to the diameters of the coins.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as shall fall within the scope of the appended claims.

I claim:

1. In a coin separating and counting apparatus including an upper rail and a lower rail spaced from the upper rail to define a coin slot therebetween, conveying means for moving a plurality of coins of various diameters in said coin slot, counting means for counting coins which have fallen from specified position in said slot, wherein said lower rail is arranged to guide a bottom point of each of said plurality of coins and said upper rail is arranged to guide a top portion of each of said plurality of coins until one of said coins reaches a point at which a width of said coin slot is larger than a diameter of said one of said coins, at which point said one of said coins is no longer guided by said upper rail and said one of said coins falls and is counted by said counting means, wherein a width of the coin slot defined by said upper and lower rails increases incrementally in the direction of movement of the conveying mans such that coins having a smallest diameter fall first and are counted by the counting means, and coins having a second to smallest diameter fall second and are counted by the counting means, the improvement wherein:

said conveying means comprise a chain including a multiplicity of links, each said link having a punch-out plate formed in one side thereof, each said punch-out plate having a main portion formed integrally on and extending in a substantially perpendicular direction from said link, a distal outer end of each said punch-out plate extending at an angle of approximately 15° from the perpendicular direction in a direction of movement of the conveying means to thereby ensure that the coins are stably supported and moved by the punch-out plates during movement of the chain.

* * * * *